US012680171B2

(12) United States Patent
Muñoz Arroyo et al.

(10) Patent No.: US 12,680,171 B2
(45) Date of Patent: Jul. 14, 2026

(54) MATERIAL DEPOSITION METHOD FOR REPAIRING AERONAUTICAL COMPONENTS

(71) Applicant: INDUSTRIA DE TURBO PROPULSORES, S.A.U., Zamudio (ES)

(72) Inventors: Raúl Muñoz Arroyo, Zamudio (ES); Isaac Gómez Sánchez, Zamudio (ES); Alberto Gutiérrez López, Zamudio (ES); Jorge Gayubo Nieto, Zamudio (ES); Irene García Cano, Barcelona (ES); Sergi Dosta Parras, Barcelona (ES)

(73) Assignee: INDUSTRIA DE TURBO PROPULSORES, S.A.U., Zamudio (ES)

( * ) Notice: Subject to any disclaimer, the term of this patent is extended or adjusted under 35 U.S.C. 154(b) by 238 days.

(21) Appl. No.: 17/811,010

(22) Filed: Jul. 6, 2022

(65) Prior Publication Data

US 2023/0009918 A1 Jan. 12, 2023

(30) Foreign Application Priority Data

Jul. 7, 2021 (EP) ..... 21382613

(51) Int. Cl.

| | |
|---|---|
| ***C23C 24/04*** | (2006.01) |
| ***B22F 1/05*** | (2022.01) |
| *B22F 7/06* | (2006.01) |

(52) U.S. Cl.
CPC ..... *C23C 24/04* (2013.01); *B22F 1/05* (2022.01); *B22F 2007/068* (2013.01); *B22F 2301/15* (2013.01); *B22F 2304/10* (2013.01)

(58) Field of Classification Search
CPC ..... C23C 24/04; B22F 1/05
See application file for complete search history.

(56) References Cited

U.S. PATENT DOCUMENTS

| | | | | |
|---|---|---|---|---|
| 6,905,728 | B1 * | 6/2005 | Hu | B22F 7/08 427/140 |
| 2010/0136242 | A1 * | 6/2010 | Kay | B05B 7/1486 427/427 |
| 2011/0078896 | A1 * | 4/2011 | Calla | B23P 6/00 29/598 |
| 2019/0009300 | A1 * | 1/2019 | Mahalingam | B05D 7/14 |

FOREIGN PATENT DOCUMENTS

| | | | | |
|---|---|---|---|---|
| CN | 107723699 | A * | 2/2018 | B24C 1/10 |
| CN | 107723699 | B | 12/2019 | |
| DE | 10 2007 056451 | A1 | 5/2009 | |
| JP | 2015-137367 | A | 7/2015 | |

* cited by examiner

*Primary Examiner* — Tabatha L Penny
(74) *Attorney, Agent, or Firm* — Knobbe, Martens, Olson & Bear, LLP

(57) ABSTRACT

An aeronautical component comprising a nickel-based alloy can be repaired by surface preparation and deposition of layers on a damaged portion. The aeronautical component can include a nickel-based alloy that is one of the following: MAR-M247, CM247LC, or CMSX-4.

18 Claims, No Drawings

MATERIAL DEPOSITION METHOD FOR REPAIRING AERONAUTICAL COMPONENTS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

FIELD

The present disclosure relates to a method for repairing an aeronautical component comprising a nickel-based alloy.

The present disclosure also relates to an aeronautical component comprising a nickel-based alloy and one or more of the following elements: tungsten, cobalt, chromium, aluminum, molybdenum, tantalum, titanium, hafnium, carbon, boron, and zirconium.

BACKGROUND

Structural aeronautical components manufactured from alloys with chemical compositions adapted to the future requirements to which said aeronautical components will be subjected are known. Furthermore, depending on where they are used, these aeronautical components must withstand different environmental conditions such as, for example, high temperatures or highly corrosive environmental conditions. In response to these requirements, a superalloy having a precise chemical composition is often used in aeronautical components in order to adapt it to the necessary requirements in this field.

The nickel-based superalloy known as MAR-M-247 is used in hot areas of structural parts, for example, aeronautical turbines, which are subjected to high requirements, particularly in highly corrosive environments. The MAR-M-247 alloy in turn comprises aluminum and chromium, among other components. Due to the chemical composition of this alloy, and particularly to the presence of aluminum and chromium, MAR-M-247 is extremely corrosion resistant at high temperatures, and it also has good mechanical properties and physicochemical integrity at high temperatures and in corrosive environmental conditions. However, MAR-M-247 has low ductility, which complicates processes for manufacturing it by smelting, as well as poor weldability.

As a result of using aeronautical components, damaged parts can be observed therein due to the environmental conditions to which they are subjected. The repair of these aeronautical components is extremely difficult, if not impossible, or the results are of very low quality, when said repair is carried out by means of conventional methods such as Tungsten Inert Gas, Metal Inert Gas, Metal Active Gas arc welding, etc. These conventional repair methods produce local thermal stresses and possible cracks in the affected area.

Additionally, methods to perform repair by additive manufacturing, for example, by means of laser metal deposition (Laser Cladding) which results in a new layer that is metallurgically connected with the base material of the component to be repaired, are known. In this case, repair by additive manufacturing provides a lower heat input than the other mentioned methods, but it does not provide repaired areas that are free of microcracks or defects in the affected region of the component or the weld itself.

Methods for repairing aeronautical components by means of welding techniques known as brazing or wide gap brazing, which are capable of joining different materials and different components, are also known. However, these techniques to perform repair by welding often use materials with alloying elements that lower the melting point which, in many cases, gives rise in the repaired regions to fragile areas or areas with mechanical properties that are inferior to those of the base material of the aeronautical component to be repaired.

SUMMARY

The present disclosure discloses solutions for the aforementioned deficiencies present in conventional aeronautical structural component repair methods.

The present disclosure discloses a solution to the preceding problems by means of a method for repairing an aeronautical component according to claim 1 and an aeronautical component according to claim 15. The dependent claims define preferred embodiments of the disclosure.

A first inventive aspect provides a method for repairing an aeronautical component comprising a nickel-based alloy, the method comprising the following steps:

a) performing surface preparation on a damaged portion of the component, b) depositing a plurality of layers on the damaged portion of the component by means of cold spraying a powdered material by means of a non-oxidizing carrier gas, wherein the powdered material which is deposited is the same alloy as the alloy comprised in the component to be repaired or an alloy from the same family, and deposition is performed with pressure conditions between 40 and 80 bar and temperature conditions between 850 and 1100° C. of the carrier gas.

The present disclosure provides an improved method for repairing damaged portions in aeronautical components by means of an additive cold spray technique. The damaged portions in a component may comprise crack, erosion, corrosion, and burn type defects.

In particular, the disclosure discloses repairing aeronautical components by means of depositing a material which coincides with the nickel-based alloy forming said aeronautical component or which is an alloy from the same family as this alloy comprised in said component to be repaired in specific cold spraying conditions. Preferably, the powdered material which is deposited coincides with the alloy forming said aeronautical component. It will be understood that two alloys are of "the same family" when their base element (the element with the highest proportion) is the same in both, and at least two of the four main alloying elements (the next elements with the highest proportion) coincide. In the context of the disclosure, the base element is nickel.

The material of the aeronautical component, which will preferably be the same material as that used to carry out the repair, is a nickel-based alloy that is preferably poorly weldable and hardenable by γ' (hardening precipitate). A "poorly weldable" material shall be understood to mean a material which tends to crack during the welding process. More specifically, an alloy is poorly weldable when the amount of precipitate-forming elements (such as Ti, Al) is greater than 4%. Above 4%, precipitation kinetics are very fast, which gives rise to complications during welding. In particular, the precipitation of γ', both in the welding process and in subsequent heat treatments, generates residual stresses in the part which may lead to the occurrence of cracks (strain age cracking). In addition to this problem, the occurrence of cracks in the grain boundary in the area affected by heat (HAZ cracking) due to the formation of phases having a low melting point (grain-boundary liquefaction) is also common in welding processes. This liquefaction is usually caused by the presence of carbides and the segregation of other elements in the grain boundary which, when rapidly heated, are incapable of completely dissolving in the matrix, and said partial dissolution gives rise to eutectic phases having a low melting point and to the melting of the grain boundary.

For example, the MAR-M247 alloy is highly susceptible to the occurrence of strain age cracking given its large precipitate-forming element fraction (Ti+Al>6%), and it is also susceptible to the occurrence of HAZ cracking, taking into account the presence of carbides in the grain boundary, as well as interdendritic γ-γ' eutectic.

The method of the disclosure comprises two steps: a first step a) of preparing the damaged surface of the component, and a second step b) of applying the material by means of performing deposition under specific conditions of the carrier gas. The carrier gas is an inert gas which entrains and propels the particles of the deposition powder and protects them from oxidation.

Once the damaged portion or region of the aeronautical component is identified, step a) in which the surface of this damaged portion of the component is prepared is started. The preparation of the surface will be understood to mean the conditioning of the surface to be treated to thereby facilitate, a posteriori, the deposition of the material in step b). In other words, to ensure a good result in the subsequent deposition step and accordingly achieve a successful repair as a result, the damaged portion is first prepared.

After the preparation of the surface in step a), the method continues with step b) in which the deposition of a material on the damaged portion of the component is carried out. This deposition comprises cold spraying said powdered material, such that layers are gradually deposited one on top of the other on the surface to be treated. In particular, the powdered material is cold sprayed by means of the action of a non-oxidizing carrier gas.

Cold spraying is a solid-state material deposition process. This technique uses a non-oxidizing carrier gas which is compressed and used as a propellant gas to accelerate the particles of the powdered material at a high speed, causing deposition when the powder particles impact a substrate or surface to be treated. The formation of a deposit by means of cold spraying depends mainly on the kinetic energy of the particles before the impact, instead of their thermal energy. The powdered material used for cold spraying remains in solid state throughout the entire deposition process. Deposition is achieved by means of local metallurgical bonding and mechanical interlocking resulting from the plastic deformation at the interfaces between the powder particles and the surface.

According to the present disclosure, the deposition step (step b) is carried out under specific pressure and temperature conditions. In particular, the pressure is comprised between 40 and 80 bar, and the temperature is comprised between 850 and 1100° C. These conditions ensure a successful outcome in the repair performed by means of depositing a nickel-based alloy, with said nickel-based alloy being the same alloy as the alloy comprised in the component to be repaired or an alloy from the same family as said nickel-based alloy.

The present method provides the following advantages:

- obtaining a very compact repair coating in the damaged portion which has a high adherence and is free of defects;
- ensuring the deposition of uniform layers that are free of porosity and oxidation, without the material of the component to be repaired melting or being affected as a result of excessive heat; and
- ensuring a successful repair both in the manufacturing process and once the aeronautical component is already in service, even in the case of materials having a poor weldability.

In a particular embodiment, the nickel-based alloy further comprises one or more of the following elements: tungsten, cobalt, chromium, aluminum, molybdenum, tantalum, titanium, hafnium, carbon, boron, and zirconium; preferably comprising tungsten, cobalt, chromium, aluminum, molybdenum, tantalum, titanium, and hafnium. This group of elements selectively makes up the preferred alloys for the present disclosure and are known as MARM-247, CM247LC, and CMSX-4. All these nickel-based alloys with poor weldability are of particular interest in the manufacture of aeronautical components, and according to the present disclosure, can be used as a base material or alloy for repairing these components. In a more particular embodiment, the alloy may comprise other trace elements, such as silicon or manganese.

In a particular embodiment, step b) comprises:

- depositing an anchoring layer with first pressure and temperature conditions of the carrier gas,
- depositing at least one growth layer on the anchoring layer with second pressure and temperature conditions of the carrier gas;

wherein

- the first pressure and temperature conditions are different from the second pressure and temperature conditions, or
- the first pressure and temperature conditions are the same as the second pressure and temperature conditions.

As mentioned above, cold spraying involves depositing a plurality of layers on the damaged portion of the component. Each of these layers of material is deposited with pressure and temperature conditions specific to the non-oxidizing carrier gas. Step b) comprises depositing the so-called anchoring layer as a first layer, and then depositing at least one growth layer on said anchoring layer. The conditions for depositing the anchoring layer and the growth layer/layers may coincide with one another or may be different from one another. In other words, the anchoring layer is deposited with first pressure and temperature conditions which may be the same as or different from the second pressure and temperature conditions with which the growth layers are deposited after the anchoring layer.

In a preferred embodiment, the pressure and temperature conditions of the anchoring layer are lower than the pressure and temperature conditions of the growth layer. More particularly, the pressure and temperature conditions of the anchoring layer are 45-70 bar and 850-1100° C.; and the pressure and temperature conditions of the growth layer are 65-75 bar and 1000-1100° C.

In a particular embodiment, the method comprises depositing a plurality of growth layers, preferably at least four growth layers. The growth layers are gradually deposited one after another in step b) such that the first growth layer is deposited on the previously deposited anchoring layer.

Advantageously, once adherence with the surface of the damaged portion is ensured, the deposition conditions can be modified to improve process efficiency.

In an embodiment, the alloy comprises up to 0.2% carbon, 5-14% chromium, 5-15% cobalt, up to 4% molybdenum, up to 12% tungsten, up to 12% tantalum, up to 1% vanadium, up to 1% niobium, 3-6% aluminum, up to 5% titanium, up to 2% hafnium, up to 0.02% boron, up to 0.06% zirconium, and up to 3.1% rhenium. This embodiment defines a preferred alloy of the present disclosure both for the aeronautical component and for the material used in the deposition during the repair process. The percentages of each component express the mass percentage with respect to the total mass of the alloy. More particularly, the alloy comprises: 0-0.2% carbon, 5-14% chromium, 5-15% cobalt, 0-4% molybdenum, 0-12% tungsten, 0-12% tantalum, 0-1% vanadium, 0-1% niobium, 3-6% aluminum, 0-5% titanium, 0-2% hafnium, 0-0.02% boron, 0-0.06% zirconium, and 0-3.1% rhenium.

In a particular embodiment, the alloy comprises up to 0.2% carbon, 5-14% chromium, 5-15% cobalt, up to 4% molybdenum, up to 12% tungsten, up to 12% tantalum, up to 1% vanadium, up to 1% niobium, 3-6% aluminum, up to 5% titanium, up to 2% hafnium, up to 0.02% boron, up to 0.03% zirconium, and up to 3% rhenium. This embodiment defines a preferred alloy of the present disclosure both for the aeronautical component and for the material used in the deposition during the repair process. The percentages of each component express the mass percentage with respect to the total mass of the alloy. More particularly, the alloy comprises: 0-0.2% carbon, 5-14% chromium, 5-15% cobalt, 0-4% molybdenum, 0-12% tungsten, 0-12% tantalum, 0-1% vanadium, 0-1% niobium, 3-6% aluminum, 0-5% titanium, 0-2% hafnium, 0-0.02% boron, 0-0.03% zirconium, and 0-3% rhenium.

In a preferred embodiment, the alloy comprises up to 0.17% carbon, 6.2-8.8% chromium, 9-11% cobalt, up to 0.8% molybdenum, up to 10.25% tungsten, up to 7% tantalum, up to 0.1% vanadium, up to 0.1% niobium, 5.35-5.75% aluminum, up to 1.2% titanium, up to 1.6% hafnium, up to 0.02% boron, up to 0.06% zirconium, and up to 3.1% rhenium. This embodiment defines a preferred alloy of the present disclosure both for the aeronautical component and for the material used in the deposition during the repair process. The percentages of each component express the mass percentage with respect to the total mass of the alloy. More particularly, the alloy comprises: 0-0.17% carbon, 6.25-8.8% chromium, 9-11% cobalt, 0-0.8% molybdenum, 0-10.25% tungsten, 0-72% tantalum, 0-0.1% vanadium, 0-0.1% niobium, 5.35-5.75% aluminum, 0-1.2% titanium, 0-1.6% hafnium, 0-0.02% boron, 0-0.06% zirconium, and 0-3.1% rhenium.

In a particular embodiment, step a) comprises machining and/or cleaning the surface of the damaged portion of the component and/or providing roughness to said surface.

Before carrying out deposition step b), the damaged surface to be treated is preferably prepared, such that it is free of possible oxides, dirt, etc. In particular, machining of the surface consists of removing part of the material of the damaged component to thereby adapt the surface thereof, facilitate the proper impact of the powder particles during deposition, and ensure adherence. Not only is part of the material removed during machining, but rather the damaged portion is in turn being cleaned before being treated.

In a more particular embodiment, machining is carried out with a chip removal or abrasion technique.

Furthermore, the preparation of the surface can also provide certain roughness to the surface. The application of roughness on the damaged surface which is being prepared for subsequent deposition will improve the mechanical anchoring between the first deposition layer (anchoring layer) and the surface of the damaged portion.

In a more particular embodiment, roughness is provided by abrasion, for example by means of sanding, by means of treatment with a grindstone, or by means of abrasive blasting.

In a particular embodiment, the method comprises applying a protective surface layer for protection against corrosion, wear, and/or impact on at least the damaged portion of the component after step b). In this embodiment, once the deposition of the material on the damaged portion of the component has been completed, a coating in the form of a surface layer, which is applied at least on the damaged portion, is provided on the layers of deposited material. This additional coating on the deposited material protects the damaged portion against possible corrosion, wear, and/or impact that the component may experience after repair. The protective surface layer can also be applied on other portions of the component, in addition to the damaged and repaired portion.

In a more particular embodiment, the application of a protective surface layer comprises coating at least the damaged portion of the component with aluminum. In other words, an aluminum coating is provided on the deposited material. This aluminum coating protects the surface condition of the repaired component. The aluminum coating can be carried out by means of known diffusion techniques.

In a particular embodiment, the method comprises performing a heat treatment on the damaged portion of the component in temperature conditions of between 800 and 1340° C. after step b) and/or after the application of a protective surface layer.

At times, the material which has been deposited in step b) does not exhibit all the required properties and may give rise to a fragile material. In this embodiment, to improve the properties of the deposited material, a heat treatment is performed once step b) has been completed. The deposited material is in solid state during heat treatment, but as treatment progresses, the microstructure of the deposited material changes so that it thereby achieves the desired properties. In one embodiment, the microstructure is first homogenized, and residual stresses are relieved by means of a solubilization step with a first temperature value. Then, the heat treatment is completed with a second precipitation step at a temperature value that is lower than the first value in order to achieve precipitation of the hardening phases, conferring the deposited material with optimized final properties. The heat treatment can be carried out under vacuum conditions. In one embodiment, the heat treatment is performed at a temperature of 800-1340° C. under vacuum conditions. As a result of the heat treatment, bonding between the deposited layers and the substrate or surface of the damaged portion is favored, in turn relieving stresses between them and even favoring the atomic diffusion of the deposited layers with the substrate.

In a particular embodiment, the method comprises performing non-destructive tests on the damaged portion of the component to check the condition thereof. These non-destructive tests take place at any intermediate stage in the repair process. Advantageously, the absence of defects or indications of damage (cracks, pores, inclusions, etc.), which may develop into possible future defects at the end of the repair process or once the component is in service, is confirmed by means of these tests. Some examples of non-destructive test methods that could be applied are as follows: application of penetrating liquids, application of induced currents, X-rays, ultrasound, and thermography.

In a particular embodiment, in step b), deposition is performed at a distance of 15-40 mm from the surface of the damaged portion of the component, preferably 25 mm. These deposition distance conditions ensure the proper stacking of the layers of sprayed material on the surface of the damaged portion and thereby the proper adherence between them.

In a particular embodiment, the powdered material has a particle size comprised between 10 and 75 μm.

Advantageously, with this range of particle sizes, the deposition efficiency could be increased and greater thicknesses achieved.

In a particular embodiment, in step b) the pressure of the carrier gas is in the range between 40 and 70 bar and the temperature is in the range between 1000 and 1100° C.

A second inventive aspect provides an aeronautical component formed by a nickel-based alloy and one or more of the following elements: tungsten, cobalt, chromium, aluminum, molybdenum, tantalum, titanium, hafnium, carbon, boron, and zirconium; preferably comprising tungsten, cobalt, chromium, aluminum molybdenum, tantalum, titanium, and hafnium; the component comprising:

at least one damaged portion, a plurality of layers deposited on the damaged portion, wherein the plurality of deposited layers are of the same alloy as the alloy comprised in the aeronautical component or an alloy from the same family.

All the features and/or method steps described in this specification (including the claims, description, and drawings) can be combined in any combination, with the exception of combinations of such mutually exclusive features.

DETAILED DESCRIPTION

The present disclosure discloses an improved method for repairing aeronautical components with nickel-based alloys having a poor weldability by means of cold spraying, achieving very compact coatings that are free of porosity and defects in the repaired areas.

Some of the superalloys which are of particular interest for the disclosure as they comprise a nickel base and have a poor weldability are, for example, MARM-247, CM247LC, and CMSX-4.

The superalloy MARM-247 comprises the following elements expressed as % by weight: 0.13-0.17% carbon, 8-8.80% chromium, 9-11% cobalt, 0.5-0.8% molybdenum, 9.75-10.25% tungsten, 2.8-3.1% tantalum, 5.35-5.65% aluminum, 0.9-1.2% titanium, 0.01-0.02% boron, 0.03-0.06% zirconium, 1.4-1.6% hafnium, incidental impurities and nickel to balance the alloy. In an embodiment, the mentioned incidental impurities comprise the following elements expressed as % or ppm by weight: 0-0.1% copper, 0-0.1% rhenium, 0-0.5% iron, 0-0.1% manganese, 0-0.1% niobium, 0-0.01% phosphorus, 0-0.1% silicon, 0-0.1% vanadium, 0-2 ppm silver, 0-20 ppm arsenic, 0-0.5 ppm bismuth, 0-0.2 ppm cadmium, 0-25 ppm gallium, 0-0.2 ppm indium, 0-50 ppm magnesium, 0-35 ppm nitrogen, 0-20 ppm oxygen, 0-5 ppm lead, 0-0.015 ppm sulfur, 0-5 ppm antimony, 0-3 ppm selenium, 0-20 ppm tin, 0-1 ppm tellurium, 0-0.5 ppm thallium, and 0-5 ppm zinc.

In an example, the superalloy MARM-247 comprises the following elements expressed as % by weight: 0.15% carbon, 8% chromium, 10% cobalt, 0.6% molybdenum, 10% tungsten, 3.0% tantalum, 5.5% aluminum, 1.0% titanium, 0.015% boron, 0.03% zirconium, 1.5% hafnium, incidental impurities and nickel to balance the alloy.

The superalloy CM247LC comprises the following elements expressed as % by weight: 0.07-0.08% carbon, 8-8.5% chromium, 9.0-9.4% cobalt, 0.4-0.6% molybdenum, 9.3-10% tungsten, 3.1-3.3% tantalum, 5.4-5.7% aluminum, 0.6-0.9% titanium, 0.010-0.018% boron, 0.006-0.015% zirconium, 1.3-1.6% hafnium, incidental impurities and nickel to balance the alloy. In an embodiment, the incidental impurities comprise the following elements expressed as % or ppm by weight: 0-0.01% copper, 0-0.15% iron, 0-0.05% manganese, 0-0.1% niobium, 0-0.005% phosphorus, 0-0.03% silicon, 0-0.1% vanadium, 0-3 ppm silver, 0-20 ppm arsenic, 0-0.2 ppm bismuth, 0-1 ppm cadmium, 0-15 ppm gallium, 0-0.2 ppm indium, 0-80 ppm magnesium, 0-15 ppm nitrogen, 0-15 ppm oxygen, 0-2 ppm lead, 0-10 ppm sulfur, 0-5 ppm antimony, 0-2 ppm selenium, 0-15 ppm tin, 0-1 ppm tellurium, 0-0.3 ppm thallium, 0-5 ppm zinc.

In an example, the nickel-based superalloy CM247LC comprises the following elements expressed as % by weight: 0.07% carbon, 8% chromium, 9% cobalt, 0.5% molybdenum, 10% tungsten, 3.2% tantalum, 5.6% aluminum, 0.7% titanium, 0.015% boron, 0.010% zirconium, 1.4% hafnium, incidental impurities and nickel to balance the alloy.

The superalloy CMSX-4 comprises the following elements expressed as % by weight: 6.0-6.6% chromium, 9.0-10% cobalt, 0.5-0.7% molybdenum, 6.0-6.6% tungsten, 6.3-7.0% tantalum, 5.40-5.75% aluminum, 0.9-1.1% titanium, 0.07-0.12% hafnium, 2.8-3.1% rhenium, incidental impurities and nickel to balance the alloy. In an embodiment, the incidental impurities comprise the following elements expressed as % or ppm by weight: 0-100 ppm carbon, 0-20 ppm magnesium, 0-150 ppm zirconium.

In an example, the nickel-based superalloy CMSX-4 comprises the following elements expressed as % by weight: 6% chromium, 9% cobalt, 0.6% molybdenum, 6% tungsten, 7% tantalum, 5.6% aluminum, 1.0% titanium, and 0.1% hafnium, incidental impurities and nickel to balance the alloy.

A particular example of the method for repairing an aeronautical component made up of the MARM-247 alloy is described below. This method comprises the following two steps:

a) performing surface preparation on a damaged portion of the component, b) depositing a plurality of layers on the damaged portion of the component by means of cold spraying a powdered material by means of a non-oxidizing carrier gas.

Before starting the repair, the region of the component where the damaged portion is located is identified. Once this damaged portion is located, the method is started with step a), in which surface preparation of said damaged portion of the component is performed. In one embodiment, in this first step, machining by means of chip removal, which removes part of the material of this component, is carried out to thereby ensure a proper impact of the powder particles during the subsequent deposition step, and to in turn facilitate adherence between the elements. In turn, cleaning of the surface is performed, removing possible oxides or dirt that may be found on the surface of the damaged portion to be treated so as to ensure that the repair is effective. Alternatively, roughness can also be provided on the actual surface of the damaged portion by means of abrasion (for example by means of sanding, abrasive blasting, etc.), thereby improving the mechanical anchoring between the layers of deposited material and the treated surface in the next step.

Once the surface preparation of the damaged portion has been performed, deposition step b) is started. Deposition is performed by means of cold spraying the MARM-247 alloy (the same alloy forming the damaged component to be repaired) on the damaged portion of the component in the form of layers that are gradually stacked one on top of another on the portion in question. This cold spraying is carried out by means of the action of a non-oxidizing carrier gas in specific pressure and temperature conditions. In one embodiment, MARM-247 powder particles having a size between 10 and 75 μm are cold sprayed.

In this particular example, deposition is carried out by first depositing a first anchoring layer and a plurality of growth layers are then sequentially deposited on this anchoring layer until reaching at least 4 growth layers. The pressure and temperature conditions for the deposition of the anchoring layer and growth layers are different. In particular, in one embodiment, the anchoring layer is deposited with a pressure and a temperature of the carrier gas that are lower than the pressure and temperature used for the growth layers.

In this deposition step b), the powder particles are sprayed at a distance of 25 mm from the surface on which these particles will be deposited, forming the anchoring layer and the growth layers.

Once the deposition step has been completed, in a particular embodiment, a coating type protective surface layer protecting the damaged portion that has been repaired against corrosion, wear, or impact is applied. This protective coating covers all the layers deposited on the damaged portion. The surface condition of the component after repair is thereby assured. In a particular embodiment, the coating applied is an aluminum coating or an intermetallic coating rich in this element.

Furthermore, to favor bonding between the deposited layers and the treated surface, in one embodiment, a heat treatment is carried out in temperature conditions between 800 and 1340° C. This treatment can be carried out directly on the damaged portion of the component after step b) has been completed or on the protective surface layer. This heat treatment in turn relieves the stresses between the layers of deposited material and the surface of the damaged portion and also favors atomic diffusion either between the anchoring layer and the surface of the damaged portion or else between the layers of deposited material.

Several repair tests have been performed on damaged portions in aeronautical components according to the conditions of the particular example above, in which the MARM-247 alloy has been used. Successful outcomes with very compact coatings, a porosity below 1%, and an excellent adherence at about 65-70 MPa before heat treatment, are achieved by means of the present method.

Although the example above refers to a component manufactured from the MARM-247 alloy, the present disclosure is applicable to components manufactured from other materials. Furthermore, although a component manufactured from MAR-M247 has been repaired in the described example using powder of the same alloy, in other embodiments a different alloy can be used for repair, for example, MAR-M247 powder can be used to repair a component manufactured from MAR-M002, since the latter is part of the same family as the MAR-M247 alloy.

The present method also contemplates the option of performing non-destructive tests on the damaged portion of the component to check its condition. These tests can be carried out during the repair process to ensure the absence of defects or indications of damage such as cracks, pores, or inclusions.

What is claimed is:

1. A method for repairing an aeronautical component comprising a nickel-based alloy, the method comprising the following steps:

a) performing surface preparation on a damaged portion of the component; and b) depositing a plurality of layers on the damaged portion of the component by cold spraying a powdered material by a non-oxidizing carrier gas, wherein the powdered material which is deposited is the same alloy as the nickel-based alloy comprised in the component to be repaired, deposition is performed with pressure conditions between 40 and 80 bar and temperature conditions between 85° and 1100° C. of the carrier gas, and step b) comprises:

depositing an anchoring layer of the plurality of layers with first pressure and temperature conditions of the carrier gas; and depositing at least one growth layer of the plurality of layers on the anchoring layer with second pressure and temperature conditions of the carrier gas, wherein the first pressure and temperature conditions are different from the second pressure and temperature conditions, and wherein the second pressure and temperature conditions are 65-75 bar and 1000-1100° C.

2. The method according to claim 1, further comprising depositing a plurality of growth layers.

3. The method according to claim 2, wherein depositing the plurality of growth layers comprises depositing at least four growth layers.

4. The method according to claim 1, wherein step a) comprises machining and/or cleaning the surface of the damaged portion of the component and/or providing roughness to said surface.

5. The method according to claim 4, wherein the roughness is provided by abrasion.

6. The method according to claim 1, further comprising applying a protective surface layer for protection against corrosion, wear, and/or impact on at least the damaged portion of the component after step b).

7. The method according to claim 6, wherein the application of the protective surface layer comprises coating at least the damaged portion of the component with aluminum.

8. The method according to claim 6, further comprising performing a heat treatment on the damaged portion of the component in temperature conditions between 800 and 1340° C. after the application of the protective surface layer.

9. The method according to claim 1, further comprising performing a heat treatment on the damaged portion of the component in temperature conditions between 800 and 1340° C. after step b).

10. The method according to claim 1, further comprising performing non-destructive tests on the damaged portion of the component to check a condition thereof.

11. The method according to claim 1, wherein in step b) deposition is performed at a distance of 15-40 mm from the surface of the damaged portion of the component.

12. The method according to claim 11, wherein in step b) deposition is performed at a distance of 25 mm from the surface of the damaged portion of the component.

13. The method according to claim 1, wherein the powdered material has a particle size comprised between 10 and 75 μm.

14. The method according to claim 1, wherein in step b) the first pressure and temperature conditions are 40-70 bar and 1000-1100° C.

15. The method according to claim 1, wherein the nickel-based alloy is one of the following: MAR-M247, CM247LC, or CMSX-4, wherein MARM-247 comprises the following elements expressed as % by weight: 0.13-0.17% carbon, 8-8.80% chromium, 9-11% cobalt, 0.5-0.8% molybdenum, 9.75-10.25% tungsten, 2.8-3.1% tantalum, 5.35-5.65% aluminum, 0.9-1.2% titanium, 0.01-0.02% boron, 0.03-0.06% zirconium, and 1.4-1.6% hafnium, wherein CM247LC comprises the following elements expressed as % by weight: 0.07-0.08% carbon, 8-8.5% chromium, 9.0-9.4% cobalt, 0.4-0.6% molybdenum, 9.3-10% tungsten, 3.1-3.3% tantalum, 5.4-5.7% aluminum, 0.6-0.9% titanium, 0.010-0.018% boron, 0.006-0.015% zirconium, and 1.3-1.6% hafnium, and wherein CMSX-4 comprises the following elements expressed as % by weight: 6.0-6.6% chromium, 9.0-10% cobalt, 0.5-0.7% molybdenum, 6.0-6.6% tungsten, 6.3-7.0% tantalum, 5.40-5.75% aluminum, 0.9-1.1% titanium, 0.07-0.12% hafnium, and 2.8-3.1% rhenium.

16. The method according to claim 1, wherein the nickel-based alloy further comprises one or more of the following elements: tungsten, cobalt, chromium, aluminum, molybdenum, tantalum, titanium, hafnium, carbon, boron, and zirconium.

17. The method according to claim 1, wherein the nickel-based alloy comprises up to 0.2% carbon, 5-14% chromium, 5-15% cobalt, up to 4% molybdenum, up to 12% tungsten, up to 12% tantalum, up to 1% vanadium, up to 1% niobium, 3-6% aluminum, up to 5% titanium, up to 2% hafnium, up to 0.02% boron, up to 0.06% zirconium, and up to 3.1% rhenium.

18. The method according to claim 1, wherein the first pressure and temperature conditions are 45-70 bar and 850-1100° C.

* * * * *